US007896783B2

(12) United States Patent
Kessler

(10) Patent No.: US 7,896,783 B2
(45) Date of Patent: Mar. 1, 2011

(54) DOUBLE DUTCH JUMP ROPE

(75) Inventor: Brian D. Kessler, Los Angeles, CA (US)

(73) Assignee: Maui Toys, Inc., Youngstown, OH (US)

( * ) Notice: Subject to any disclaimer, the term of this patent is extended or adjusted under 35 U.S.C. 154(b) by 0 days.

(21) Appl. No.: 12/740,973

(22) PCT Filed: Oct. 21, 2008

(86) PCT No.: PCT/US2008/080580

§ 371 (c)(1),
(2), (4) Date: Apr. 30, 2010

(87) PCT Pub. No.: WO2009/058605

PCT Pub. Date: May 7, 2009

(65) Prior Publication Data

US 2010/0248907 A1 Sep. 30, 2010

Related U.S. Application Data

(60) Provisional application No. 60/983,981, filed on Oct. 31, 2007.

(51) Int. Cl.
*A63B 5/20* (2006.01)

(52) U.S. Cl. ..... 482/82

(58) Field of Classification Search ..... 482/23, 482/24, 34, 44, 45, 81, 82, 91, 109, 110, 482/120, 121, 126, 139; D21/672; 119/794–799; 473/256, 424; 446/247
See application file for complete search history.

(56) References Cited

U.S. PATENT DOCUMENTS 3,517,931 A 6/1970 Kalish
4,158,457 A 6/1979 Hydro
4,177,985 A 12/1979 Hlasnicek et al.
4,375,886 A * 3/1983 Muys ..... 482/82
4,637,606 A 1/1987 Hunn
4,647,037 A 3/1987 Donohue
4,784,391 A * 11/1988 Herron ..... 273/109
4,892,063 A 1/1990 Garrigan
4,955,601 A 9/1990 Ueng (Continued)

*Primary Examiner*—Loan Thanh
*Assistant Examiner*—Daniel F. Roland
(74) *Attorney, Agent, or Firm*—Browdy and Neimark, PLLC

(57) ABSTRACT

A jump rope having a rope section having two ends, and a connector attached to one end of the rope section, the connector having a hook section, a middle section connected at one end to the hook section, and a flange section integral with the other end of the middle section. An end cap is attached to another end of the rope section. The first handle has two open ends and a conical shape, one of the open ends having a smaller size fixedly connected to the end cap. The second handle has two open ends and a conical shape, one of the open ends having a smaller size configured to slide over the flange section of the connector and abut against the middle section of the connector allowing the connector to spin freely in the handle when the jump rope is in use and the connector is not connected to another jump rope. When the jump rope is connected to another jump rope, the second handle can be locked to the first handle so as not to be sliding around on the jump rope when the jump rope is in use.

4 Claims, 1 Drawing Sheet

U.S. PATENT DOCUMENTS

| | | | | |
|---|---|---|---|---|
| 5,236,405 | A | 8/1993 | Dohmann et al. | |
| 5,643,149 | A | 7/1997 | Grimaldi et al. | |
| 5,803,017 | A * | 9/1998 | Stewart | 119/799 |
| 6,453,851 | B1 * | 9/2002 | Holt et al. | 119/795 |
| 6,524,226 | B2 | 2/2003 | Kushner | |
| 6,544,148 | B1 | 4/2003 | Loew | |
| 6,634,994 | B2 | 10/2003 | Reid et al. | |
| 6,712,026 | B1 * | 3/2004 | Carville, Jr. | 119/796 |
| 6,752,746 | B1 | 6/2004 | Winkler et al. | |
| 6,827,045 | B1 * | 12/2004 | Willner et al. | 119/795 |
| 6,860,841 | B1 * | 3/2005 | Mortorano | 482/126 |
| 2005/0176562 | A1 | 8/2005 | Huang | |
| 2006/0027189 | A1 * | 2/2006 | Luber | 119/795 |

* cited by examiner

DOUBLE DUTCH JUMP ROPE

FIELD OF THE INVENTION

The present invention relates to a jump rope having a connector at one end to allow two jump ropes to be easily connected together to form one double length rope.

BACKGROUND OF INVENTION

Jump ropes and other rope devices that include the ability to connect easily to other like ropes are known. For example, U.S. Pat. No. 3,517,931 to Kalish, discloses a convertible jump rope that can be extend to create a double length jump rope. When extended, a member 22, formed of a light weight material in the shape of a thin-walled sleeve, covers the connection point of the ends of the two single length ropes (see FIG. 2).

U.S. Pat. No. 4,892,063 to Garrigan, discloses a leash for two or more animals. The leash comprises at least one leash member having a snap fastener at each end 12, 22 and a flexible, yieldable, compressible handle 14 slidably disposed on the leash member between these snap fasteners. The leash may include a central closed hook 28 that attaches to a central "D" ring 30.

Kushner, in U.S. Pat. No. 6,524,226, describes an exercise device having a pair of elastic bands having inner ends joined together by a releasable fastener. More specifically, as shown in FIG. 1, the fastener 16 comprises a snap hook with body portion 34 pivotally secured to a coupling ring 32. The fastener 16 releasably grasps an attachment ring 62. The snap hook 16 and attachment ring 62 are disposed within protective coverings 64, 66, constructed of foam rubber. The two bands may be used separately, as shown in FIG. 2, or as a double length exercise device as shown in FIGS. 3 and 4.

Grimaldi et al., in U.S. Pat. No. 5,643,149, disclose a fitness rope suitable for jump roping exercises. The device includes an elastic rope 12 having secured to one end 14 a segment of flexible material 20. Conventional joining means 24 connect the end 14 of elastic rope 12 and the end 22 of the flexible material 20. The joining means 24 may be releasable or permanent. A hollow handle (30) is slidable along the flexible segment 20. The passageway 36 of the hands 30 is of sufficient diameter to permit passage of end 26 of the flexible segment 20 thereto, as shown in FIG. 2.

Additional examples of are found in U.S. Pat. Nos. 4,158,457, 4,177,985, 4,637,606, 4,647,037, 4,955,601, 5,236,405, 6,544,148, and 6,752,746, and U.S. Patent Publication Nos. 2002/0123413 and 2005/0176562.

SUMMARY OF INVENTION

The present invention relates to a jump rope that includes a connector at one end to allow the jump rope to be removably connected to another jump rope to allow two individual jump ropes to become one long unit. Each end of the jump rope also contains a handle with a cone shape. The handle at a first end of the jump rope is fixed to that end, while the handle at the other end can be slid to the opposite end and locked in place at the first end during use, creating an extended handle.

The present invention is characterized in particular by a jump rope having a rope section having two ends, and a connector attached to one end of the rope section, the connector having a hook section, a middle section connected at one end to the hook section, and a flange section integral with the other end of the middle section. An end cap is attached to another end of the rope section. The first handle has two open ends and a conical shape, one of the open ends having a smaller size fixedly connected to the end cap. The second handle has two open ends and a conical shape, one of the open ends having a smaller size configured to slide over the flange section of the connector and abut against the middle section of the connector allowing the connector to spin freely in the handle when the jump rope is in use and the connector is not connected to another jump rope. When the jump rope is connected to another jump rope, the second handle can be locked to the first handle so as not to be sliding around on the jump rope when the jump rope is in use.

BRIEF DESCRIPTION OF DRAWINGS

For a more complete understanding of the present invention, reference is now made to the following description of embodiments of the invention conjunction with the accompanying drawing figures, wherein.

DETAILED DESCRIPTION OF EMBODIMENTS

Figure 1:
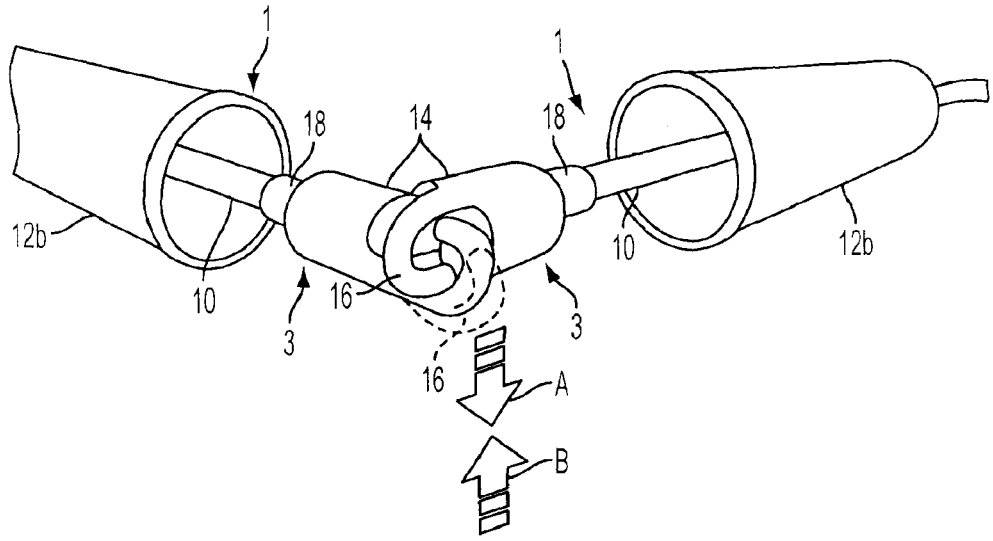
FIG. 1 is a expanded perspective view of the connectors for the jump ropes in accordance with the present invention.
Figure 2:
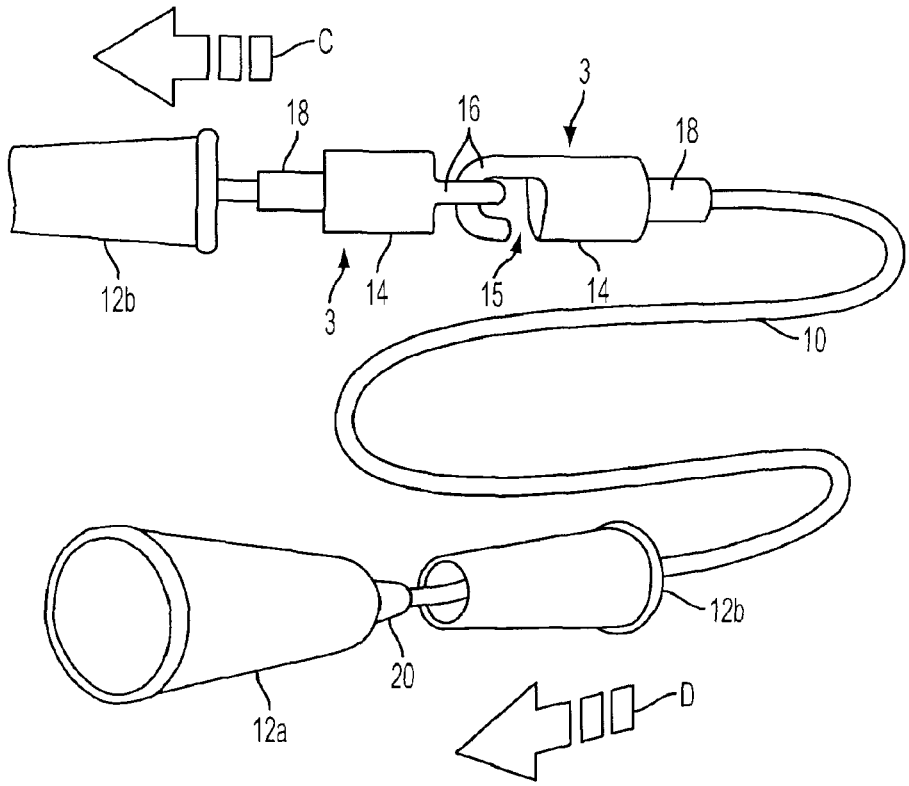
FIG. 2 is a side view of the jump rope connected to another jump rope in accordance with the present invention.

The jump rope of the present invention is configured as shown in FIGS. 1 and 2, to allow two such jump ropes to be used individually, or connected together to form one longer jump rope. The jump rope 1 includes a rope section 10 having two ends. An end cap 20 is fixed to one end of the rope section 10. According to one embodiment, handles 12*a*, 12*b* have a conical shape, one end having a narrower opening than the other end. The narrower end of handle 12*a* is fixed to the end cap 20. According to one embodiment, the handles 12*a*, 12*b* are made of a semi-rigid, flexible material. Such materials include, for example, polyvinyl chloride, K-Resin, or polyethylene. The use of other suitable materials is within the skill of the ordinary artisan. The handles may be tinted in multiple colors or may be a solid color.

The other end of the jump rope section 10 has a connector 3. According to one embodiment, the connector 3 has three sections; a hook section 16, a middle section 14, and a flange section 18. The hook section 16 is integral with and extends outwardly from one end of the middle section 14. The other end of the middle section is integral with the flange section 18.

According to one embodiment, handle 12*b* also has two open ends and a conical shape, one end having a narrower opening than the other end. The smaller size end of the handle 12*b* is configured to slide over the flange section 18 of the connector 3 and abut against the middle section 14 of the connector 3. This snug connection allows the connector 3 to spin freely in the handle 12*b* when the jump rope 1 is in use and the connector 3 is not connected to another jump rope. Additionally, the handle 12*b* is slidable along the length of the jump rope 10 so that, when the jump rope 1 is connected to another jump rope of the same type, the handle 12*b* can be moved to the non-connected end of the jump rope 1 and locked to the handle 12*a*. This prevents the handle 12*b* from sliding around on the jump rope when the jump rope is in use and perhaps hurting the user.

According to one embodiment, the hook section 14 is open such that the hook 16 defines a space 15 between the end of the hook 16 and the middle section 14. The hook 16 is made of a flexible, pliable plastic material that is hard enough to reliably hold the connector to another connector on another jump rope, and soft enough to allow the open hook to flex when being connected to a hook section of another jump rope and not to present a hazard while in use. For example, polyvinyl chloride may be used.

To connect two jump ropes together, the user moves the hook 16 in the direction shown by arrow A in FIG. 1, and engages hook 16 to the hook 16 of the other jump rope. Once the hooks 16 engage one another, the flexed hook springs back in the direction of arrow B, to tightly hold the two connectors together. As shown in FIG. 2, the handles 12*b* are then slid to other end of the jump rope 1 in the directions of arrows C and D, and locked into place against handles 12*a* on the respective jump ropes. The user can then use the double length jump rope as he/she would any other jump rope, without danger of the handles 12*b* or the connectors 3 causing any injury.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A jump rope, comprising:

a rope section having two ends;

a connector attached to one end of the rope section, the connector having a hook section, a middle section connected at one end to the hook section, and a flange section integral with the other end of the middle section;

an end cap attached to another end of the rope section;

a first handle having two open ends and a conical shape, one of the open ends having a smaller size fixedly connected to the end cap; and a second handle having two open ends and a conical shape, one of the open ends having a smaller size configured to slide over the flange section of the connector and abut against the middle section of the connector, wherein when the jump rope is in use and the connector is not connected to another jump rope the connector can spin freely in the second handle; and wherein when the jump rope is connected to another jump rope, the second handle can be locked to the first handle so as not to be sliding around on the jump rope when the jump rope is in use.

2. The jump rope according to claim 1, wherein the hook section comprises an open hook at one end formed of a pliable plastic material that is hard enough to hold the connector to another connector on another jump rope, and soft enough to allow the open hook to flex when being connected to a hook section of another jump rope.

3. The jump rope according to claim 2, wherein the hook section is made of polyvinyl chloride.

4. The jump rope according to claim 1, wherein the handle is made of polyvinyl chloride, K-Resin or polyethylene.

* * * * *